US007626346B2

(12) United States Patent
Scilla

(10) Patent No.: US 7,626,346 B2
(45) Date of Patent: Dec. 1, 2009

(54) LED CIRCUIT WITH CURRENT CONTROL

(75) Inventor: Giovanni Scilla, Fontane di Villorba (IT)

(73) Assignee: OSRAM Gesellschaft mit beschraenkter Haftung, Munich (DE)

( * ) Notice: Subject to any disclaimer, the term of this patent is extended or adjusted under 35 U.S.C. 154(b) by 362 days.

(21) Appl. No.: 11/819,678

(22) Filed: Jun. 28, 2007

(65) Prior Publication Data

US 2008/0224634 A1 Sep. 18, 2008

(30) Foreign Application Priority Data

Jun. 28, 2006 (EP) ..... 06425450

(51) Int. Cl.
*G07F 1/00* (2006.01)

(52) U.S. Cl. ..... 315/309; 315/307; 315/291; 315/247; 315/224

(58) Field of Classification Search ..... 315/224, 315/225, 247, 246, 291, 297, 307–326, 185 S, 315/200 A
See application file for complete search history.

(56) References Cited

U.S. PATENT DOCUMENTS 6,111,739 A 8/2000 Wu et al.
6,400,101 B1 6/2002 Biebl et al.
2002/0140380 A1* 10/2002 Biebl ..... 315/291

FOREIGN PATENT DOCUMENTS

| | | |
|---|---|---|
| EP | 1 278 402 | 1/2003 |
| EP | 1 339 263 | 8/2003 |
| WO | WO 99/07059 | 2/1999 |
| WO | WO 99/07188 | 2/1999 |

* cited by examiner

*Primary Examiner*—Tuyet Vo

(57) ABSTRACT

Circuit for regulating a current applied to an electrical load, comprising a compensation unit comprising a temperature sensor and providing an electrical signal at an output, the electrical signal depending on the current applied to the electrical load and on a temperature measured by the temperature sensor, a reference unit providing a reference electrical signal, and a control unit regulating the current applied to the electrical load depending on a difference between the electrical reference signal and the electrical signal provided at the output of the compensation unit.

22 Claims, 6 Drawing Sheets

LED CIRCUIT WITH CURRENT CONTROL

The present invention relates to a circuit regulating an operating current applied to an electrical load, in particular to a light-emitting diode (LED). Furthermore, the invention relates to a circuit for regulating the operating current depending on the temperature.

In order to ensure reliable operation and a maximum lifetime of a semiconductor device, for instance of a light-emitting diode (LED), it is of great importance not to exceed a certain allowed maximum operation temperature. For instance, in the case of an LED it may be important to limit the temperature of the p-n junction within the semiconductor die. The temperature of an LED typically depends on parameters like for instance the operating current, in the following called current, the ambient temperature, i.e. the temperature of the environment the LED is operated in, and so forth. Therefore it may be in particular important to operate the semiconductor device, for instance the LED, in the so called safe operating area (SOA), i.e. the current conditions depending on the temperature in which the semiconductor device, for instance the LED, can be operated without damage.

The SOA requirement for an LED can be characterized by a derating curve and may imply that up to a certain temperature, which may be called derating temperature, an LED can be operated with a certain constant current. Above that derating temperature the current has to be decreased in order to avoid reduction of lifetime or even instant damage of the LED. Typically, the decrease of the current depending on the temperature above the derating temperature, which may be called current derating, is proportional to the temperature, for instance with a linear or close-to-linear dependence.

In prior-art document EP 1 278 402 B1 a circuit is disclosed which is able to control the current applied to an LED depending on the ambient temperature. However, the proposed circuit is rather complex and expensive and requires quite accurate analog circuit electronics.

More specifically, the invention relates to a circuit according to the preamble of Claim 1, which is known, e.g., from U.S. Pat. No. 6,400,101.

It is therefore one object of an embodiment of the present invention to provide a circuit which is able to regulate the current applied to an electrical load such as a semiconductor device depending on a temperature.

This object may be reached by the circuit according to patent claim 1. Further preferred embodiments are recited in further patent claims.

According to at least one embodiment of the invention a circuit for regulating a current applied to an electrical load comprises

- a compensation unit comprising a temperature sensor and providing an electrical signal at an output, the electrical signal depending on the current applied to the electrical load and on a temperature measured by the temperature sensor,
- a reference unit providing a reference electrical signal, and
- a control unit regulating the current applied to the electrical load depending on a difference between the electrical reference signal and the electrical signal provided at the output of the compensation unit.

In particular, the circuit may comprise

- means for providing a first signal related to the current applied to the electrical load and to a temperature,
- means for providing a second signal which is a reference signal, and
- means for regulating the current.

Preferably the regulation of the current depends on the first signal and the second signal.

The maximum allowed current that may be applied to the electrical load may be characterized by a derating curve with a derating temperature. The derating curve may be in particular a property of the electrical load. This may imply that the maximum allowed current that may be applied to the electrical load has to be decreased for a temperature above the derating temperature. Preferably the circuit may regulate the current applied to the electrical load according to the maximum allowed current and therefore may ensure that the electrical load is operated according to the derating curve which may define the maximum allowed current depending on the temperature and characterize the safe operating area (SOA). The current derating may occur with a linear or nearly linear dependency on the temperature. Alternatively, the current derating may have a non-linear dependency on the temperature. The maximum current that may be applied to the electrical load for a temperature below the derating temperature may be constant and independent on the temperature. The derating curve may have a sharp bend at the derating temperature due to a sudden change of the maximum allowed current depending on the temperature. Alternatively, the derating curve may have a smooth transition from the maximum allowed current for temperatures below the derating temperatures to a current derating for temperatures above the derating temperature.

In at least one embodiment of the invention the electrical load is a semiconductor device, such as a diode, a radiation-emitting semiconductor device as for instance an LED or a laser diode, or a transistor, or any other semiconductor device. Alternatively, the electrical load may be a plurality of semiconductor devices which may be the same or different devices.

The emission spectrum of a radiation-emitting semiconductor device may comprise any wavelength or combination of wavelengths ranging from ultra-violet to infrared.

In at least one preferred embodiment of the invention the semiconductor device or the plurality of semiconductor devices is an LED or a plurality of LEDs. In particular, in the following "LED" can represent a single LED or a plurality of LEDs. A plurality of LEDs may be connected in series and/or in parallel. For instance, the circuit may control the current that is applied to a plurality of similar LEDs which are connected in series. In this case it may be sufficient to control the current that is applied to one LED of the plurality of LEDs in order to comply with the SOA requirement of all LEDs. A plurality of LEDs may comprise LEDs emitting with a similar emission spectrum or with a different emission spectrum forming a single-color LED stack or a multi-color LED stack.

In at least one embodiment of the invention current derating depending on the temperature may be advantageous for the lifetime and reliability of an electrical load as for example an LED, because the current derating may avoid thermal runaway. Thermal runaway may occur if a direct compensation of the luminous flux of the LED is used so that the luminous flux may be controlled to remain constant instead of a compensation using current derating depending on the temperature. As the luminous flux may decrease with rising temperature, a higher current may be applied to compensate for the lower luminous flux. However, a higher current may at the same time also increase the temperature of the p-n junction of the LED semiconductor die so that such compensation may further increase the current applied to the LED resulting in further heating of the semiconductor die and eventually destroying the semiconductor die. Therefore, current derating depending on the temperature may provide a controlled temperature of the p-n junction as well as a controlled luminous flux.

In at least one embodiment of the invention the temperature sensor may be any element or device such as an electric or electronic element or device with a temperature dependent property. The temperature dependent property may be for example a resistance, a voltage, a current, an optical property, or any other property. In particular, any electric or electronic element or device that changes a voltage, a current, a resistance, or a combination thereof depending on the temperature may be suitable as temperature sensor. Examples for temperature sensors may be a resistor, a thermistor element with a negative temperature coefficient (NTC thermistor) or with a positive temperature coefficient (PTC thermistor), a thermocouple, a silicon bandgap temperature sensor, a non-contact thermometer such a an infrared thermometer, or any other suitable thermometer or temperature sensitive device or element.

The temperature measured by the temperature sensor, which may be called "temperature" in the following, may be the ambient temperature of the environment where the electrical load is operated in. In this case the temperature sensor may be placed at a distance to the electrical load or even far away from the electrical load so that the current applied to the electrical load may depend on a temperature which is mainly or even only dependent on the ambient temperature. Alternatively, it may be advantageous if the temperature sensor is placed in close vicinity to the electrical load or to a part of the electrical load. For example the electrical load may comprise for example a substrate or support, for instance a housing, an encapsulation, a printed circuit board (PCB), or a lead frame. The temperature sensor may be situated close to the substrate or support, on the substrate or support, inside the substrate or support, or otherwise attached to the substrate or support. The temperature of the substrate or support may depend on both the ambient temperature and on the temperature of the electrical load. Further, it may be even more advantageous if the temperature sensor is placed as close as possible to or even attached to or mounted on the electrical load. In case of a semiconductor device, for example an LED, the temperature sensor may be placed close to the p-n junction of the LED semiconductor die and/or in contact with the substrate or support of the LED. Preferably the temperature sensor may be thermally-conductive connected to the load. The thermal contact between the temperature sensor and the electrical load may be preferably established by a direct contact. Alternatively the thermal contact may be established due to convection or thermal radiation between the electrical load and the temperature sensor.

Alternatively the temperature sensor may comprise a plurality of temperature sensors which may be placed in different places or alternatively close to each other. It may be advantageous if the plurality of signals of the plurality of temperature sensors is processed to form a single signal. The processing of the signals may comprise taking a sum, a difference, a product, a mean value, or any combination of the plurality of signals. Each signal of the plurality of signals may be processed with different weighting or unweighted, and the processing of the plurality of signals may be done by analog or digital means. Processing a plurality of temperature signals forming a single signal may be for instance advantageous if the electrical load comprises a plurality of semiconductor devices and the temperature of each of the semiconductor devices of the plurality of the semiconductor devices is measured by one or more temperature sensors, respectively. The plurality of temperature sensors may comprise similar temperature sensors or different temperature sensors for example depending on the positions and temperatures the temperature sensors are situated in.

In at least one embodiment of the invention the electrical reference signal and/or the electrical signal at the output of the compensation unit are voltages. Alternatively, the electrical reference signal and/or the electrical signal at the output of the compensation unit are currents. In at least one embodiment of the invention the electrical reference signal is a constant reference voltage which may be in a range of 1 to 2.5 V, more preferred in a range of 1 to 1.5 V. Even more preferred the constant reference voltage may be 1.235 V. Preferably, the electrical signal at the output of the compensation unit may also be a voltage.

In at least one embodiment of the invention the current applied to the electrical load is in a range of 300 to 1000 mA and preferably in a range of 600 to 800 mA. A current in said range may be typical for LEDs, in particular for high-power LEDs. In particular, a current in said range may be applied for a temperature below the derating temperature.

In at least one embodiment of the invention the compensation unit comprises means for providing an electrical signal depending on the current applied to the electrical load. Furthermore the compensation unit may comprise means for providing an bias signal depending on the temperature measured by the temperature sensor and for a superposition of the electrical signal depending on the current applied to the electrical load with the bias signal. The superposition may form the electrical signal provided at the output of the compensation unit. The superposition may be preferably a sum, or alternatively a difference, a product, or a ratio of the electrical signal depending on the current applied to the electrical load and the bias signal. In case the super-position is a sum the bias signal may cause a temperature-dependent offset signal that is added to the electrical signal depending on the current applied to the electrical load. The offset signal may be equal to the bias signal or may be proportional to the bias signal.

In at least one embodiment of the invention the compensation unit has an input which may be connected directly to the electrical load or indirectly via other electronic elements or for example via inductive coupling. Preferably, the input may be connected directly to the electrical load so that the input signal of the compensation unit is the current applied to the electrical load. Alternatively, the input signal may be a signal which is proportional to the current applied to the electrical load. The signal which is proportional to the current applied to the electrical load may be a voltage or a current.

The compensation unit may further comprise a shunt resistor with an input and an output terminal which connects the input of the measurement device to an electrical reference potential. If the input signal of the compensation unit is a current, for instance the current applied to the electrical load, the current may flow through the shunt resistor so that a voltage drop can be measured between the input and the output terminal of the shunt resistor. The voltage drop between the input and the output terminal of the shunt resistor may correspond to the voltage drop between the input of the compensation unit and the electrical reference potential. The voltage difference may be proportional to the current flowing through the shunt resistor. The electrical reference potential may be ground potential or any other electrical potential being different from ground potential and forming a virtual ground potential. Voltages may be measured with respect to the electrical reference potential.

In at least one embodiment of the invention the expression "resistor" may refer to a single resistor or impedance or to a plurality of resistors or impedances which are connected in series and/or in parallel forming a resistor network. The resistance of a resistor may be constant or depending on the temperature. Further, the expression "resistor" may refer also to a plurality of resistors or impedances forming a resistor network having an effective resistance or impedance.

The compensation unit may further comprise a first resistor or a first resistor network connecting the input to the output of the compensation unit. In a at least one preferred embodiment of the invention the compensation unit further comprises a bias voltage source providing a bias voltage and a second resistor or second resistor network connecting the bias voltage source to the output of the compensation unit. This may imply that the bias voltage source is connected to the shunt resistor via the first resistor or first resistor network and the second resistor or second resistor network. It may be advantageous if the second resistor network comprises the temperature sensor. In this case the temperature sensor may be preferably an NTC thermistor element which is connected in series and/or in parallel with one or further resistors forming the second resistor network. Alternatively, the first resistor network may comprise the temperature sensor, which in this case may be preferably a PTC thermistor element connected in series and/or in parallel with one or more further resistors forming the second resistor network.

A superposition of the bias voltage with the electrical signal at the input of the compensation unit may be provided at the output of the compensation unit due to the first resistor or first resistor network and due to the second resistor or second resistor network. If the first or the second resistor network comprises the temperature sensor, the superposition of the signal at the input of the compensation unit with the bias voltage may depend on the temperature measured by the temperature sensor so that the electrical signal at the output of the compensation unit may be temperature dependent. Alternatively, means for providing the superposition may further comprise active components as for example summing or differential amplifier and/or further passive components.

In at least one preferred embodiment of the invention the electrical load is a diode such as a radiation-emitting semiconductor device having a cathode and an anode. The input of the compensation unit may be connected to the cathode or to the anode or to other parts of the diode.

The bias voltage provided by the bias voltage source may be higher than a constant reference voltage provided by the reference unit. Alternatively, the bias voltage may be lower than a constant reference voltage provided by the reference unit.

In at least one preferred embodiment of the invention the control unit comprises a subtracting unit. The subtracting unit may have a non-inverting input and an inverting input and an output. The subtracting unit may provide a control signal at the output which depends on the difference between a signal at the non-inverting input and a signal at the inverting input. Instead of having a non-inverting and an inverting input, the subtracting unit may be formed for example of a summing unit in combination with an inverter. The summing unit such as a summing amplifier may have two non-inverting inputs or two inverting inputs. One of the two non-inverting inputs or of the two inverting inputs may be connected to an output of an inverter. An input of the inverter may effectively then form one input of the subtracting unit.

In at least one preferred embodiment of the invention the subtracting unit is an operational amplifier or a differential amplifier having two voltage inputs and a voltage output. The subtracting unit may be a single electronic element or device or part of an electronic element or device.

In at least one embodiment of the invention the output of the reference unit is connected to the non-inverting input of the subtracting unit of the control unit and the output of the compensation unit is connected to the inverting input of the subtracting unit. Alternatively, the output of the reference unit may be connected to the inverting input of the subtracting unit of the control unit and the output of the compensation unit may be connected to the non-inverting input of the subtracting unit. In both cases the output of the subtracting unit may provide a control signal that depends on the difference of the electrical reference signal and the electrical signal provided at the output of the compensation unit. The control signal may be preferably a voltage or it may be alternatively a current.

The control unit may further comprise means for providing the current applied to the electrical load. The electrical load may be connected to an output of said means. Further, an input of said means may be connected to the output of the subtracting unit. Preferably, the current applied to the electrical load may be proportional to the control signal. The means for providing a current may be any device or power stage that is able to provide a current depending on the control signal. Examples for such device or power stage may be a voltage-to-current converter, a voltage-controlled current source, or a step-down power switching regulator.

In at least one embodiment of the invention the circuit may further comprise means for interrupting and/or establishing application of a current to the electrical load. Means for interrupting and/or establishing application of a current to the electrical load may be for example a mechanical switch, an electrical switch as a relay, or any other suitable means. The means for interrupting and/or establishing application of a current to the electrical load may be included in the subtracting unit, between the subtracting unit and the means for providing a current, included in the means for providing a current, between the control unit and the electrical load, between the electrical load and the compensation unit or at any other suitable position in the circuit.

In at least one embodiment of the invention the current applied to the electrical load is regulated so that the difference between the electrical reference signal and the electrical signal provided at the output of the compensation unit is minimized, in particular zero or close to zero. Alternatively, the difference may be any value different from zero.

A method for regulating a current applied to an electrical load may comprise

- providing an electrical signal depending on the current applied to the electrical load and on a temperature,
- providing an electrical reference signal, and
- regulating the current applied to the electrical load depending on a difference between the electrical reference signal and the electrical signal.

In at least one embodiment of the invention the method may further comprise measuring the temperature my means of a temperature sensor.

The method for regulating a current applied to an electrical load may further comprise

- measuring a signal depending on the current applied to the electrical load,
- providing a bias signal depending on the temperature, and
- providing a superposition of the signal depending on the current applied to the electrical load (4) with the bias signal depending on the temperature.

Further features, embodiments, and advantages of the invention are disclosed in the following in connection with the description of the exemplary embodiments in accordance with the figures.

In the Figures similar elements or elements with similar functionalities are referred to by similar reference numerals.

Figure 1:
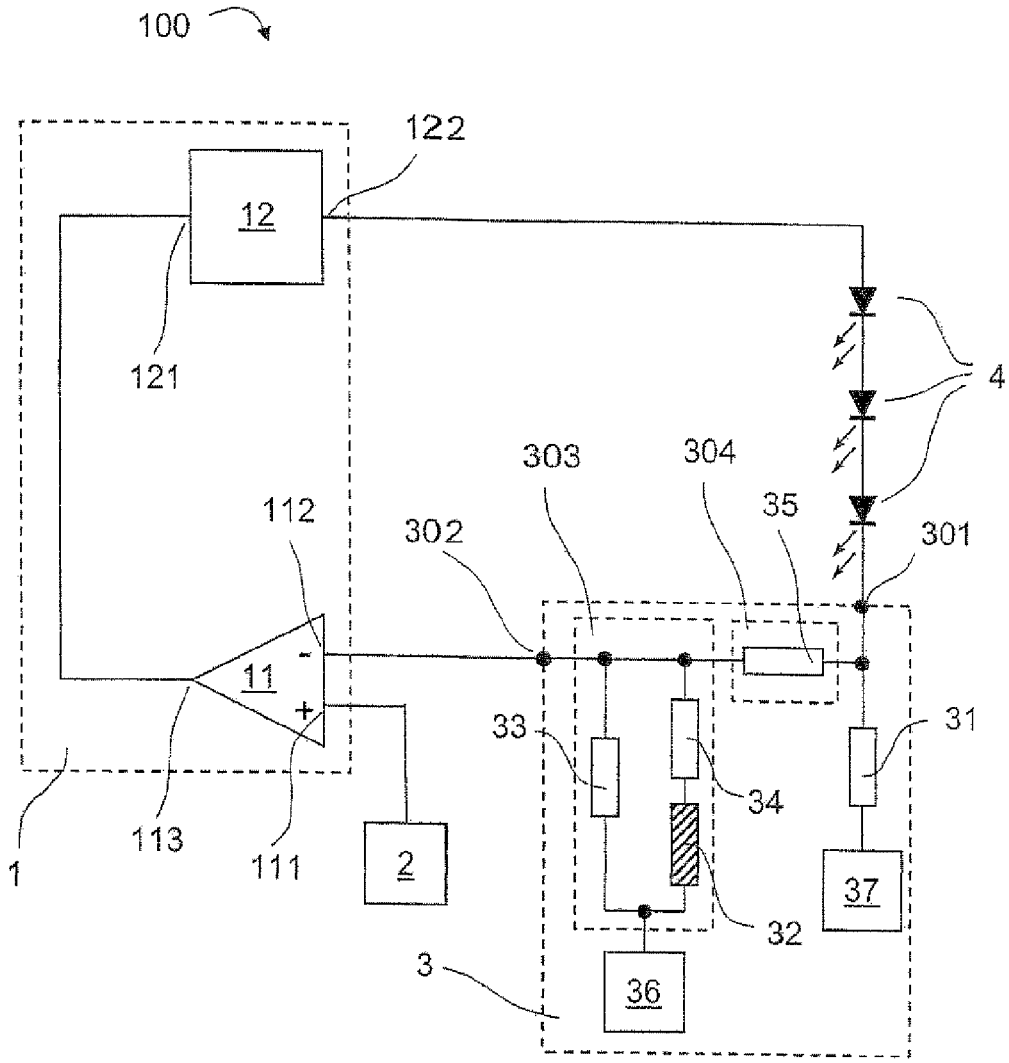
FIG. 1 shows a block diagram according to at least one embodiment of the invention.

FIG. 1 shows a circuit 100 according to at least one embodiment of the invention. The circuit 100 may be able to regulate the current applied to a plurality of LEDs 4 which form an electrical load. The number of LEDs of the plurality of LEDs 4 shown in FIG. 1 is only by way of example and may be any number including a single LED. Further, the plurality of LEDs 4 may be preferably connected in series but may be also connected in parallel or may form a network of LEDs connected in series and in parallel.

The circuit 100 includes a control unit 1 with a subtracting unit 11 having a non-inverting input 111, an inverting input 112 and an output 113. A reference unit 2 providing a reference voltage is connected to the non-inverting input 111. A compensation unit 3 providing a signal at an output 302 is connected to the inverting input 112. The signal provided at the output 302 of the compensation unit may be preferably a voltage.

The subtracting unit 11 may provide a control signal depending on the difference between the reference voltage at input 111 and the signal provided by output 302 of the compensation unit 3 at input 112. The control signal, which may be preferably a voltage, may regulate a current provided by means 12, which is for example a current source such as a power stage that provides a current depending on a control signal. The power stage 12 is connected to the output 113 of the subtracting unit 11 and provides a current at an output 122 which depends on the control signal provided by the subtracting unit 11. The subtracting unit 11 adjusts the control signal at output 113 in such a way that the difference between the input 111 and the input 112 is minimum, preferably zero. Such subtracting unit 11 may be for example an operational amplifier. The plurality of LEDs 4 is connected at the anode side to the output 122 of the power stage 12 and at the cathode side to an input 301 of the compensation unit.

The compensation unit 3 has a shunt resistor 31 which connects the input 301 to a reference potential 37 which is preferably ground potential or alternatively a virtual ground potential. The current applied to the plurality of LEDs 4 may flow through the shunt resistor 31 and a voltage drop between the input 301 and the reference potential may be proportional to the current applied to the LEDs 4. A first resistor network 303 connects a bias voltage source 36 to the output 302 and to a second resistor network 304 formed by a resistor 35. The resistor network 303 has a resistor 33 connected in parallel to a resistor 34 which is connected in series with a thermistor forming the temperature sensor 32. The thermistor 32 may be preferably an NTC thermistor. Resistor 35 forming the second resistor network 304 connects the input 301 to the output 302 and to the first resistor network 303. Via the resistor network 303 and the resistor 35 a bias voltage provided by the bias voltage source 36 can be applied to the shunt resistor 31. The bias voltage in connection with the resistor network 303 and the resistor 35 may lead to an offset voltage proportional to the bias voltage provided at the output 302 of the compensation unit. Therefore, if a current is applied to the plurality of LEDs 4 a superposition of the voltage drop at the shunt resistor with the offset voltage can be provided at the output 302.

As shown in FIG. 1 the compensation unit may be preferably a passive resistor network with a bias voltage source. The bias voltage may be higher than the reference voltage provided by the reference unit 2.

The current applied to the plurality of LEDs 4 is regulated in such a way that the difference of the voltage at output 302 and the reference voltage provided by the reference unit 2 may be minimized and preferably zero. Thus, the current can be adjusted by the choice of the shunt resistor 31 and the offset voltage which is adjustable by the choice of the bias voltage, the resistors 33, 34, and 35 and the thermistor 32. The power dissipation of the shunt resistor 31 is proportional to the resistance of the shunt resistor 31 so that the shunt resistor may be preferably chosen as small as possible. Thus, increasing the offset voltage while keeping a constant current applied to the plurality of LEDs 4 may require a reduction of the resistance of the shunt resistor therefore limiting the power dissipated by the shunt resistor.

The thermistor 32 is preferably in close contact with at least one LED of the plurality of LEDs 4. The thermistor 32 changes its resistance depending on the sensed temperature which may be the temperature of the at least one LED, preferably the temperature of the p-n junction of the semiconductor die of the LED or a temperature proportional to the temperature of the semiconductor die. If the temperature of the at least one LED changes due to a change of the semiconductor die or due to a change of the ambient temperature, the resistance of the thermistor also changes and therefore also the resistance of the resistor network 303 may change. A change of the resistance of the resistor network 303 may change the offset voltage and therefore also the signal provided at the output 302 of the compensation unit 3. For example an increase of the temperature may decrease the resistance of the resistor network 303 and therefore increase the offset voltage and therefore the signal at the output 302 of the compensation unit 3. Due to the change of the signal at output 302 which is provided to the input 112 of the subtracting unit 11 of the control unit 1 the subtracting unit 11 may change the control signal at the output 113. A changed control signal may change the current provided by the power stage 12 which is applied to the plurality of LEDs and which causes a voltage drop at the shunt resistor 31 of the compensation unit 3. The current applied to the plurality of LEDs will be eventually adjusted by the control unit 1 in such a way that the difference of the voltage provided at output 302 of the compensation unit 3 and the reference voltage provided by the reference unit 2 is again minimized and preferably zero. In particular, the control unit 1 may reduce the current applied to the plurality of LEDs if the temperature sensed by the thermistor 32 increases.

The shunt resistor 31 may be two resistors of about 1.5Ω (+/−1%) which are connected in parallel. The resistor 33 may have a resistance of about 20500Ω (+/−1%), the resistor 34 may have a resistance of about 6800Ω (+/−1%), and the resistor 35 may have a resistance of about 10000Ω (+/−1%). The NTC thermistor 32 may have a resistance of about 680000Ω (+/−10%) at a temperature of 25° C. and a B-value of 4500 K. An L5972 step down power switching regulator available from ST MICROELECTRONICS may provide a bias voltage of about 3.3 V. The L5972 may further form the control unit 1 providing a reference unit providing a reference voltage of about 1.235 V, the subtracting unit 11 and the power stage 12 providing a current of at least up to about 1000 mA.

Figure 2A:
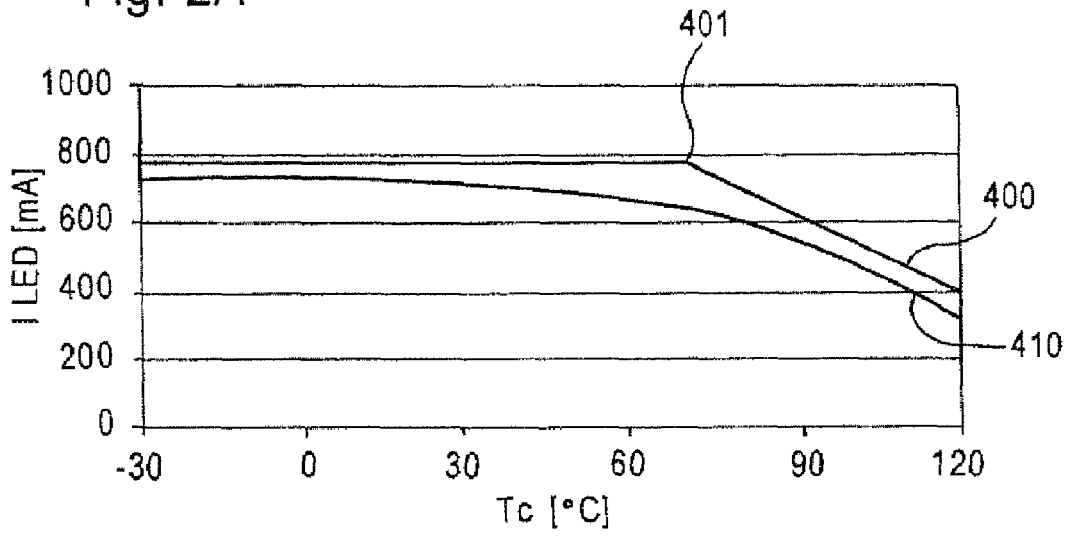
FIGS. 2A and 2B show a current-temperature dependence according to at least one embodiment of the invention.
Figure 2B:
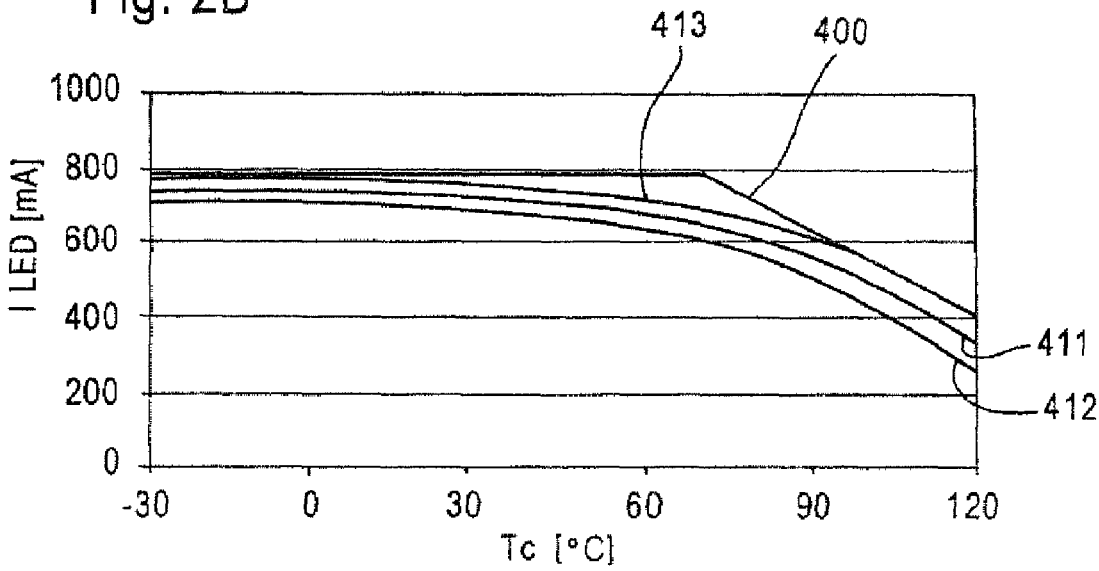

In FIGS. 2A and 2B graphs characterizing the operation behavior of the circuit 100 according to the embodiment of FIG. 1 are shown. Both graphs show on the horizontal axis the temperature (Tc) in Degree Celsius (° C.) measured by the NTC thermistor 32 being situated close to an LED 4. Further, on the vertical axis the current (ILED) in Milliampere (mA) applied to the LED 4 is shown.

In FIG. 2A derating curve 400 represents the safe operating area (SOA) requirement for an LED 4 showing a constant current-temperature dependency up to a point 401 at about 70° C. which is the derating temperature. The maximum current that may be applied to the LED 4 is therefore constant up to the derating temperature at point 401. For a temperature Tc higher than the derating temperature the maximum current that may be applied to the LED 4 decreases with a linear dependence on the temperature Tc. Curve 410 shows the current applied to the LED 4 by the circuit 100 according to the embodiment of FIG. 1. For any temperature Tc curve 410 is lower than curve 400 meaning that for any temperature Tc the applied current is lower than the SOA requirement implying a save operation of the LED 4 over the whole temperature range shown in FIG. 2A.

In FIG. 2B the graph shows the derating curve 400 representing the SOA requirement of LED 4 as in FIG. 2A. Curve 411 shows the theoretical temperature dependency of circuit 100 according to the nominal values of the components disclosed in connection with the embodiment of FIG. 1. Curves 412 and 413 represent the upper and lower limit of that dependency according to the tolerances of the disclosed components. As Curve 413 representing the theoretical upper limit of the current applied to the LED 4 is close to but lower than curve 400 for the whole temperature range shown, the LED 4 may be operated according to the SOA requirement for the whole temperature range shown also taking into account a current regulation tolerance of about +/−(5 . . . 7)%. Furthermore, circuit 100 may be able to operate LED 4 at or at least close to the optimum working point and may be able to realize a compromise between a maximum applied current, influencing LED luminous flux and therefore an LED brightness, and an controlled LED junction temperature, influencing the LED life time.

The graphs in FIGS. 2A and 2B show only examples of current-temperature dependencies for a particular set of components used in circuit 100 according to the embodiment of FIG. 1. Therefore, circuits 100 using different components may show different current-temperature dependencies which may be suitable for different LEDs 4 or different electrical loads 4.

Figure 3:
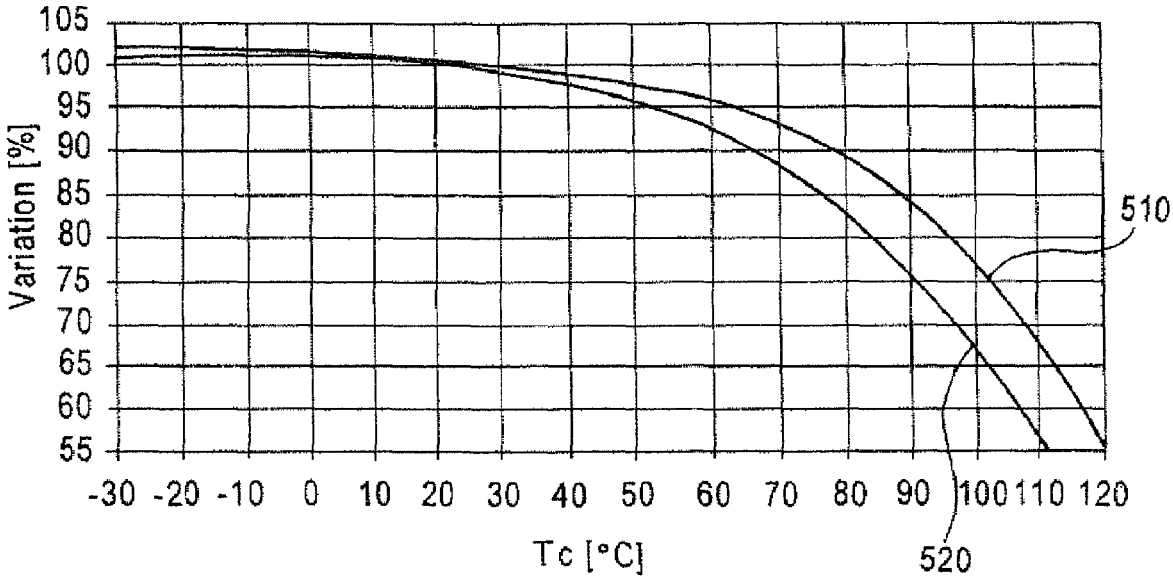
FIG. 3 shows the relative variation of a current and a luminous flux depending on the temperature according to at least one embodiment of the invention.

In FIG. 3 a further graph characterizing the operation behavior of the circuit 100 in connection with an LED 4 according to the embodiment of FIG. 1 is shown. Curve 510 shows the relative variation of the luminous flux and curve 520 shows the relative variation of the current applied to the LED 4 depending on the temperature Tc. The horizontal axis corresponds to the horizontal axis of FIGS. 2A and 2B.

Figure 4A:
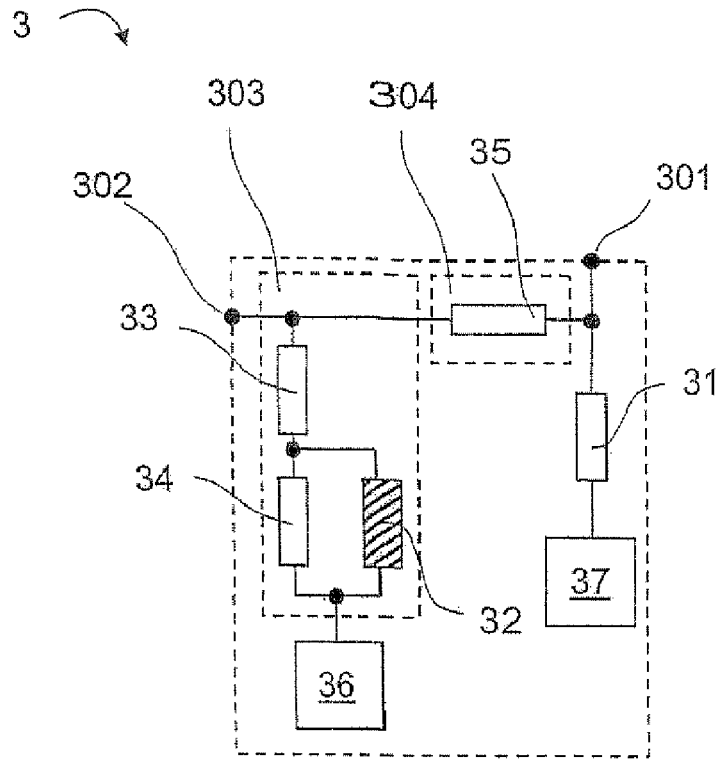
FIGS. 4A to 4D show block diagrams according to further embodiments of the invention.
Figure 4B:
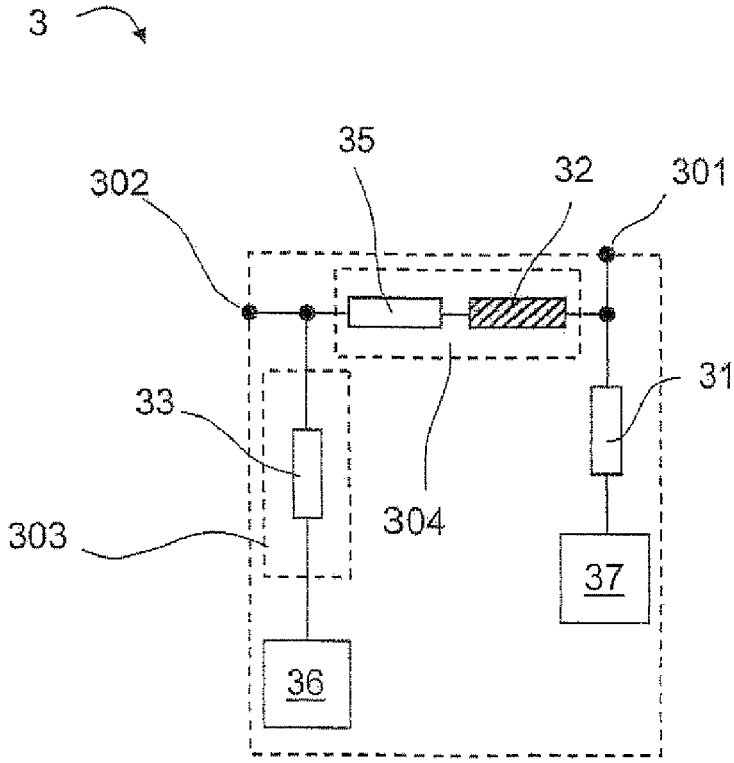
Figure 4C:
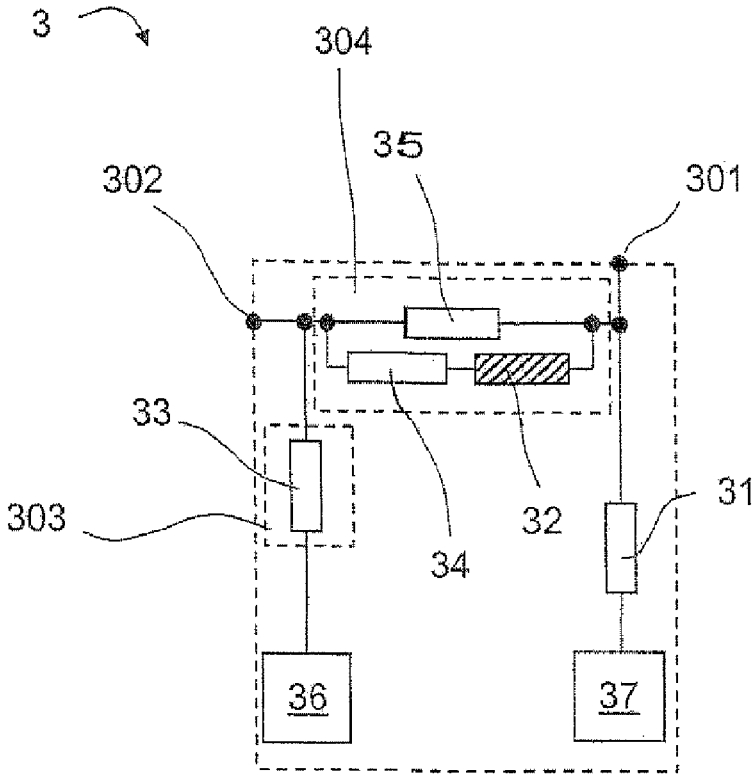
Figure 4D:
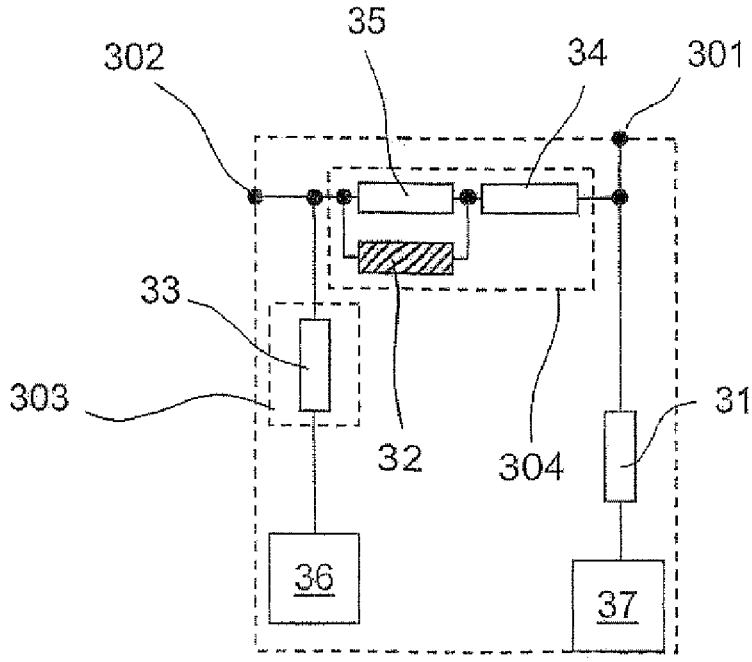

FIGS. 4A to 4D show further embodiments of the compensation unit 3 which may replace the compensation unit 3 in circuit 100 according to the embodiment of FIG. 1. The embodiments according to FIGS. 4A and 4D are only shown by way of example for further passive networks which may be used for compensation unit 3.

The compensation unit 3 according to the embodiment of FIG. 4A shows a variation of the resistor network 303 having preferably an NTC thermistor 32 connected in parallel with a resistor 34. Thermistor 32 and resistor 34 are connected in series with resistor 33. The parameters of the components, i.e. the resistances of resistors 33, 34, 35, thermistor 32, and shunt resistor 31, and the bias voltage provided by the bias voltage source 36, may differ from the parameters given in connection with the embodiment according to FIG. 1.

According to the embodiments of FIGS. 4B to 4D the input 301 of the compensation unit 3 is connected to the output 302 via a second resistor network 304 including preferably a PTC thermistor 32 and resistor 35 or resistors 34 and 35, respectively. The bias voltage source 36 is connected to the output 302 by a resistor 33 forming a first resistor network 303. The parameters of the components, i.e. the resistances of resistors 33, 34, 35, thermistor 32, and shunt resistor 31, and the bias voltage provided by the bias voltage source 36, may differ from the parameters given in connection with the embodiment according to FIG. 1.

Figure 5:
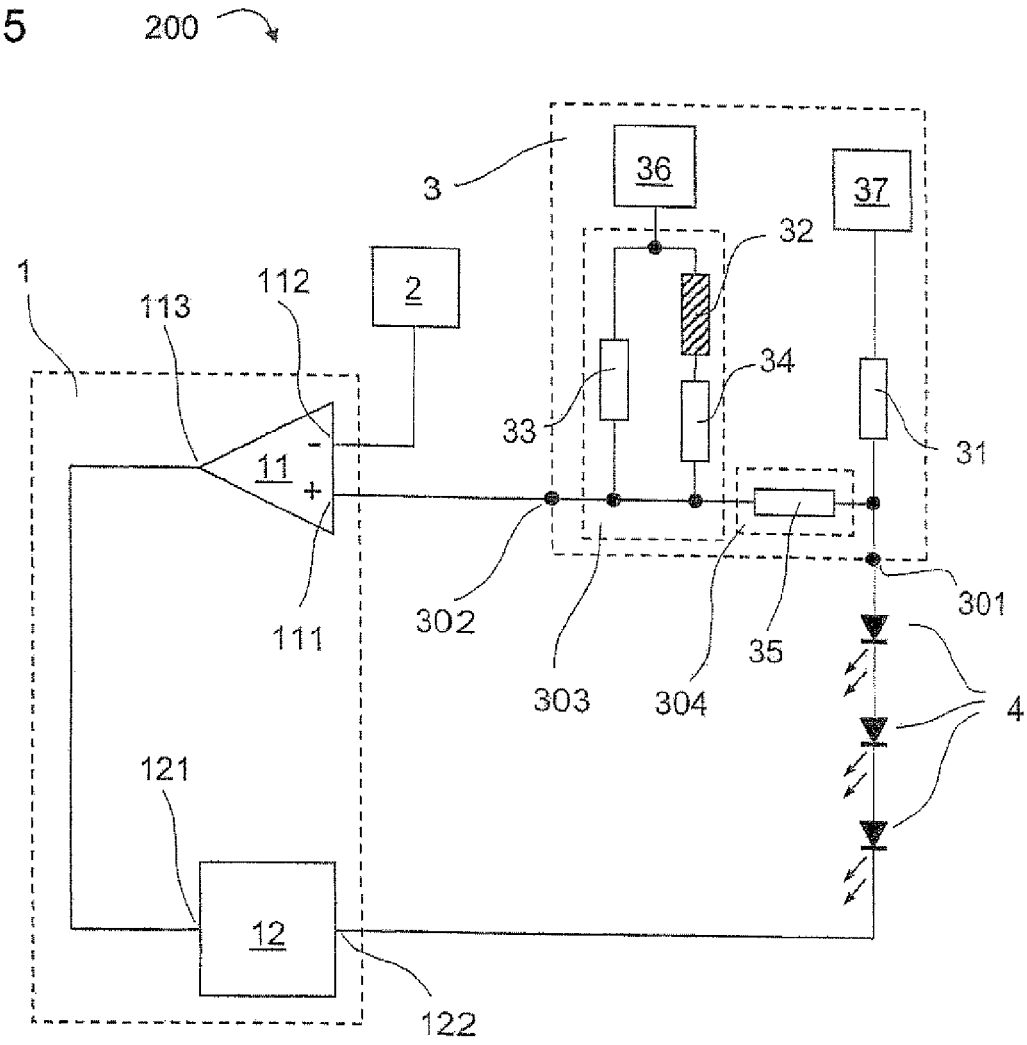
FIG. 5 shows a block diagram according to another embodiment of the invention.

The embodiment of FIG. 5 shows circuit 200 which is a variation of circuit 100 according to the embodiment of FIG. 1. However, in circuit 200 the output 122 of the power stage 12 is connected to the cathode side of the LED or plurality of LEDs 4 and the compensation unit 3 is connected to the anode side of the LED or plurality of LEDs 4. The output 302 of the compensation unit 3 is connected to the non-inverting input 111 of the subtracting unit 11 and the reference unit 2 is connected to the inverting input 112. The bias voltage provided by the bias voltage source 36 may be preferably smaller than the reference voltage provided by the reference unit 2.

According to further embodiments a compensation unit 3 according to the embodiments of FIGS. 4A to 4D can replace the compensation unit 3 according to the embodiment of FIG. 5.

The scope of the invention is not limited to the exemplary embodiments described herein. The invention is embodied in any novel feature and any novel combination of features which include any combination of features which are disclosed herein as well as stated in the claims, even if the novel feature or the combination of features are not explicitly stated in the claims or in the embodiments.

The invention claimed is:

1. Circuit for regulating a current applied to an electrical load (4), comprising a compensation unit (3) comprising a temperature sensor (32) and providing an electrical signal at an output (302), the electrical signal depending on the current applied to the electrical load (4) and on a temperature measured by the temperature sensor (32), a reference unit (2) providing a reference electrical signal, and a control unit (1) regulating the current applied to the electrical load (4) depending on a difference between the electrical reference signal and the electrical signal provided at the output (302) of the compensation unit (3), characterized in that:

the compensation unit (3) further comprises means for providing an electrical signal depending on the current applied to the electrical load (4), means for providing a bias signal depending on the temperature measured by the temperature sensor (32) and for a superposition of the electrical signal depending on the current with the bias signal forming the electrical signal provided at the output (302) of the compensation unit (3), and said means for providing the bias signal comprise a first resistor network (303) connecting a bias voltage source (36) to the output (302), the bias voltage source providing a bias voltage, and a second resistor network (304) connecting the input (301) to the output (302); wherein the first resistor network (303) or the second resistor network (304) comprises the temperature sensor (32).

2. The circuit according to claim 1, wherein
the electrical load (4) has a derating temperature and
the current applied to the electrical load (4) is decreased for a temperature above the derating temperature.

3. The circuit according to claim 1, wherein the temperature measured by the temperature sensor (32) is an ambient temperature, a temperature of the electrical load (4), a temperature of a part of the electrical load (4), or a combination thereof.

4. The circuit according to claim 1, wherein the current applied to the electrical load (4) is in the range of 300 to 1000 mA.

5. The circuit according to claim 1, wherein
the electrical load (4) comprises at least one LED and
the input (301) of the compensation unit (3) is connected to the cathode of the LED.

6. The circuit according to claim 1, wherein
the electrical load comprises at least one LED and
the input (301) of the compensation unit (3) is connected to the anode of the LED.

7. The circuit according to claim 1, wherein the bias voltage source (36) provides a bias voltage which is higher than the constant reference voltage.

8. The circuit according to claim 1, wherein the bias voltage source (36) provides a voltage which is lower than the constant reference voltage.

9. The circuit according to claim 1, wherein
the first resistor network (303) comprises the temperature sensor (32),
the second resistor network (304) is a resistor (35), and
the temperature sensor is an NTC element.

10. The circuit according to claim 1, wherein
the first resistor network (303) is a resistor (33),
the second resistor network (304) comprises the temperature sensor (32), and
the temperature sensor is a PTC element.

11. The circuit according to claim 1, wherein the current applied to the electrical load (4) is regulated so that the difference between the electrical reference signal and the electrical signal provided at the output (302) of the compensation unit (3) is zero.

12. The circuit according to claim 1, wherein the electrical load (4) is at least one semiconductor device.

13. The circuit according to claim 12, wherein the at least one semiconductor device is a light-emitting diode (LED) or a plurality of LEDs, the plurality of LEDs being connected in series, in parallel, or in any combination thereof.

14. The circuit according to claim 1, wherein the electrical signal provided at the output (302) of the compensation unit (3) and the reference electrical signal provided by the reference unit (2) are voltages.

15. The circuit according to claim 14, wherein the reference voltage is a constant reference voltage in the range of 1 to 2.5 V.

16. The circuit according to claim 1, wherein the compensation unit (3) further comprises an input (301) connected to the electrical load (4).

17. The circuit according to claim 16, wherein the means for providing an electrical signal depending on the current applied to the electrical load (4) comprise a shunt resistor (31) connecting the input (301) to an electrical reference potential (37).

18. The circuit according to claim 17, wherein the electrical reference potential (37) is ground or virtual ground.

19. The circuit according to claim 1, wherein the control unit (1) comprises a subtracting unit (11)
having a non-inverting input (111) and an inverting input (112), the non-inverting input connected to the reference unit (2) and the inverting input (112) connected to the output (302) of the compensation unit (3) or the non-inverting input connected to the output (302) of the compensation unit (3) and the inverting input (112) connected to the reference unit (2),
providing a control signal at an output (113), the control signal depending on the difference between the signals at the non-inverting input (111) and the inverting input (112).

20. The circuit according to claim 19, wherein the subtracting unit (11) is an operational amplifier or a differential amplifier and the control signal is a voltage.

21. The circuit according to claim 19, wherein the control unit (1) further comprises means (12) for providing the current applied to the electrical load (4) at an output (122) connected to the electrical load (4), the current being proportional to the control signal provided at the output (113) of the subtracting unit (11).

22. The circuit according to claim 21, wherein the means (12) for providing the current comprises a voltage-controlled current source or voltage-to-current converter.

* * * * *